US010982398B1

(12) United States Patent
Williams

(10) Patent No.: US 10,982,398 B1
(45) Date of Patent: Apr. 20, 2021

(54) PATCH AND CRACK SEALING DEVICE AND ASSEMBLY

(71) Applicant: Douglas Williams, Colfax, NC (US)

(72) Inventor: Douglas Williams, Colfax, NC (US)

( * ) Notice: Subject to any disclaimer, the term of this patent is extended or adjusted under 35 U.S.C. 154(b) by 63 days.

(21) Appl. No.: 16/546,507

(22) Filed: Aug. 21, 2019

Related U.S. Application Data

(60) Provisional application No. 62/720,185, filed on Aug. 21, 2018.

(51) Int. Cl.

| | |
|---|---|
| ***E01C 23/00*** | (2006.01) |
| ***E01C 23/09*** | (2006.01) |
| ***E01C 11/00*** | (2006.01) |
| ***E01C 7/14*** | (2006.01) |
| ***E01C 7/18*** | (2006.01) |

(52) U.S. Cl.
CPC ..... *E01C 23/0966* (2013.01); *E01C 7/147* (2013.01); *E01C 7/187* (2013.01); *E01C 11/005* (2013.01)

(58) Field of Classification Search
CPC ..... E01C 7/147; E01C 7/187; E01C 11/005; E01C 23/0966
USPC ..... 404/82, 107, 111
See application file for complete search history.

(56) References Cited

U.S. PATENT DOCUMENTS

| | | | | |
|---|---|---|---|---|
| 4,048,735 | A * | 9/1977 | Brunty | A01D 67/00 37/434 |
| 4,502,814 | A * | 3/1985 | Trimble | E01C 23/0973 401/265 |
| 4,511,283 | A * | 4/1985 | Duval | E01C 23/0973 222/136 |
| 5,735,952 | A * | 4/1998 | Wilson, Sr. | E01C 19/16 118/100 |
| 7,029,198 | B1 * | 4/2006 | Cotto | A01D 7/06 14/76 |
| 2006/0147266 | A1 * | 7/2006 | Due | E01H 1/105 404/118 |
| 2012/0257927 | A1 * | 10/2012 | Schmidt | E01C 23/0973 404/110 |

* cited by examiner

*Primary Examiner* — Raymond W Addie
(74) *Attorney, Agent, or Firm* — MacCord Mason PLLC

(57) ABSTRACT

Patch and crack sealing devices, assemblies, and methods. In one embodiment, a device for surface repair includes an application arm having a torch heating element and an interconnect end adjacent the torch heating element. The device may include at least one applier. In particular embodiments the applier is an interchangeable applier removably coupled to the interconnect end. The result may be an improved device and method for applying/manipulating a polymer asphalt binder and construction aggregate composition at a proper application temperature.

20 Claims, 9 Drawing Sheets

PATCH AND CRACK SEALING DEVICE AND ASSEMBLY

This application claims the benefit of provisional application No. 62/720,185, filed Aug. 21, 2018, which is incorporated herein by reference in its entirety.

BACKGROUND

Field

The present disclosure relates generally to hot-applied patching materials, more particularly, to a universal tool for applying and manipulating patch materials about a surface.

Related Art

Surface patching materials and devices allow for the reduction, or even elimination, of complete resurfacing in variety of situations. One site-specific material, for instance for roadway maintenance, construction, residential and industrial applications, and the like are polymer asphalt binder and construction aggregate compositions. However, traditional application tools and manipulation methods for the compositions are cumbersome, inefficient, and challenging, for instance to meet tool demands at a particular working temperature.

Therefore, Applicant desires universal devices, assemblies, systems, and methods of operation during application and manipulation of patching materials thereof without the drawbacks presented by the traditional systems and methods.

SUMMARY

In accordance with the present inventions, universal appliers and systems for delivering and/or manipulating compositions are provided herein. These inventions provide improved systems and assemblies that are convenient, efficient and safe for the user, particularly when applying polymer asphalt binder and construction aggregate composition to a site-specific surface.

In one embodiment, a surface repair assembly includes a first device with an application arm having a torch heating element and an interconnect end adjacent the torch heating element and supporting an applier; and at least a second device with an application arm having a torch heating element and an interconnect end adjacent the torch heating element and supporting an applier, and wherein the first device and the second device are adapted to apply a polymer asphalt binder and construction aggregate composition to a site specific repair at a maintained temperature.

In particular examples, the assembly includes a portable delivery to position a composition batch adjacent the site-specific repair. The first device's interchangeable applier may include a delivery apparatus. The second device's interchangeable applier may include a crack application filler.

In another embodiment, assembly includes an application arm having an applier; a torch burning supply having an exhaust aligned about the applier and adapted to heat the applier to about 400 degrees Fahrenheit; and a polymer asphalt binder and construction aggregate composition removably deliverable about the applier, wherein the heat extends to the composition in a delivery position.

In particular examples, the composition comprises a hot-applied, pourable patching material. The composition may include a hot-applied asphalt material. The composition may bond to asphalt concrete. The composition may bond to portland cement concrete.

In another embodiment, a device for applying a polymer asphalt binder and construction aggregate composition includes an application arm having an elongated body and an interconnect distal end adapted to receive an interchangeable applier; and a moveable torch exhaust aligned on the application arm adjacent the distal end to maintain between a 350 and about 400 degrees Fahrenheit temperature about the composition, and wherein the device directly contacts and applies the polymer asphalt binder and construction aggregate composition to a site-specific surface.

In particular examples, the device includes an interchangeable applier. The interchangeable applier may include a grader apparatus. The interchangeable applier may include a delivery apparatus. The interchangeable applier may include a crack application apparatus. The torch exhaust be moveable between two or more positions along the elongated body. The torch exhaust may include a narrow proximate portion and an enlarged distal portion. The torch exhaust may include a pressurized fuel connector module. The connector module may include an anchor system. The application arm may include a handle opposing the interchangeable applier. The site-specific surface may include any surface, for instance a surface distress, a thin crack, feathered edge, a combination thereof, and the like.

In one embodiment, an apparatus for applying a polymer asphalt binder and construction aggregate composition includes an elongated body; a grading end substantially perpendicular to the elongated body; and a torch exhaust aligned adjacent the grading end.

In particular examples, the grading end includes a horizontal member aligned substantially ninety degrees from a vertical member. The vertical member may have a length extending from the horizontal member to grade the composition along a surface. The apparatus may include a pair of opposing tubins between the horizontal member end and the elongated body. Further, a tubin, for instance one, may span between the grading end and the elongated body.

In some examples, the apparatus directly grades the polymer asphalt binder and construction aggregate composition. The apparatus may grade the composition to a site-specific surface. The apparatus may grade the composition at a site-specific surface at an application temperature between about 350 and about 400 degrees Fahrenheit. The apparatus may have an attachment on the elongated body opposing the grading end.

In another embodiment, an apparatus for delivering a polymer asphalt binder and construction aggregate composition includes an elongated body; a concave receiver at a distal end of the elongated body; and a torch exhaust aligned adjacent the concave receiver.

In some examples, the concave receiver includes a sunken portion to receive the composition. The sunken portion may be about two to about five inches deep, for instance the sunken portion may be three inches deep.

In particular examples, the concave receiver delivers the composition to a site-specific surface. For instance, the apparatus may deliver composition to a site-specific surface at an application temperature between about 350 and about 400 degrees Fahrenheit.

In some examples, a pair of opposing tubins may span between the concave receiver and the elongated body. Further, a tubin, for instance a single support, may span between the concave receiver and the elongated body. Additionally, the apparatus may include an attachment on the elongated body opposing the concave receiver.

In yet another embodiment, an apparatus for manipulating a polymer asphalt binder and construction aggregate composition includes an elongated body having a distal end; a first lateral member substantially extending from the distal end; a second lateral member offset from the first lateral member and substantially extending from the distal end; and a torch exhaust aligned adjacent the first lateral member and the second lateral member.

In some examples, the first lateral member and the second lateral members are angled away from a horizontal plane of the elongated body. The first lateral member and the second lateral member may be positioned between about forty-five and about sixty-five degrees from the horizontal plane of the elongated body. The first lateral member and the second lateral member may be positioned between about fifty-five degrees from the horizontal plane of the elongated body. The first lateral member and the second lateral member may apply the composition to a site-specific surface. For instance, the apparatus may manipulate the composition into a crack site-specific surface at a temperature between about 350 and about 400 degrees Fahrenheit.

In particular examples, a pair of opposing tubins span between the lateral members and the elongated body. Further, a tubin may support between the lateral members and the elongated body. Additionally, the apparatus may have an attachment point on the elongated body opposing the lateral members.

One embodiment includes a device having an application arm having an elongated body and an interconnect distal end adapted to receive an interchangeable applier; and a moveable torch exhaust aligned on the application arm adjacent the distal end, and wherein the device directly contacts and applies a polymer asphalt binder and construction aggregate composition to a site-specific surface at an application temperature between about 350 and about 400 degrees Fahrenheit.

In particular examples, the device includes an interchangeable applier. The interchangeable applier may be a grader apparatus, delivery apparatus, manipulation device, application device, and the like. In some examples, the torch exhaust is moveable between two or more positions along the elongated body. The first position may be a narrow distance between the torch exhaust and the distal end. The second position may be a distance greater than the narrow distance between the torch exhaust and the distal end.

In some examples, the torch exhaust has a narrow proximate portion and an enlarged distal portion. For instance, the torch exhaust may have about a five and half inch distal outlet. The torch exhaust may include a pressurized fuel connector module. The connector module may include a fuel line. The connector module may include at least one control. The connector module may include an anchor system. The anchor system may include a plurality of apertures aligned with an aperture positioned on the application arm. A fastener may protrude through the apertures and securing the torch exhaust about the application arm. Thereby, the torch exhaust may be secured about the application arm in a temporary integral structural unit.

In some examples, the application arm includes a handle. The handle may have a thermal resistant layer. The site-specific surface may be a surface distress. The site-specific surface may be a thin crack, thick crack, and a combination thereof. Further, the site-specific surface may have feathered edges.

Another embodiment includes an assembly comprising an application arm having an applier; a torch burning supply having an exhaust aligned about the applier and adapted to heat the applier to about 400 degrees Fahrenheit; and a polymer asphalt binder and construction aggregate composition.

In some examples, the exhaust is repositionable along the application arm. The application arm may have an interconnect to removably connect at least one the applier. The applier may be a grader apparatus, delivery apparatus, crack application apparatus, and the like.

In particular examples, the composition comprises a hot-applied, pourable patching material. The composition may be a self-adhesive patching material. The composition may be a hot-applied asphalt material. The composition may be a hot-applied concrete material. The composition may bond to asphalt concrete. The composition may bond to portland cement concrete. The composition comprises a hot-applied bridge deck surface material or the like. Further, the composition may a road berm material, slope material, boarder material, barrier material, and a combination thereof.

In another embodiment, a device for surface repair includes an application arm having: a torch heating element, and an interconnect end adjacent the torch heating element; and an interchangeable applier removably coupled about the interconnect end.

In particular examples, the interchangeable applier comprises a grader apparatus, delivery apparatus, crack application filler, and the like. The torch heating element may be moveable between two or more positions along the application arm. The first position may include a narrow distance between the torch heating element and the interconnect end. The second position may include a wide distance between the torch heating element and the interconnect end. The torch heating element may have a narrow proximate portion and an enlarged distal portion, for instance about a five and half inch distal outlet. The torch heating element may include a pressurized fuel connector module. The connector module may include a fuel line. The connector module may include at least one control. Further, the connector module may include an anchor system. The anchor system may include at least one aperture aligned with an aperture on the application arm. The anchor system may include a fastener securing the torch heating element about the application arm. The
torch heating element may be secured about the application arm in a temporary integral structural unit.

In some examples, the application arm includes a handle. The handle may include a thermal resistant layer. The surface repair may include a site-specific surface consisting essentially of a surface distress. The surface repair may include a site-specific surface consisting essentially of a thin crack, thick crack, the like, and a combination thereof. Further, the surface repair may include a site-specific surface consisting essentially of feathered edges.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF EMBODIMENTS

Figure 1:
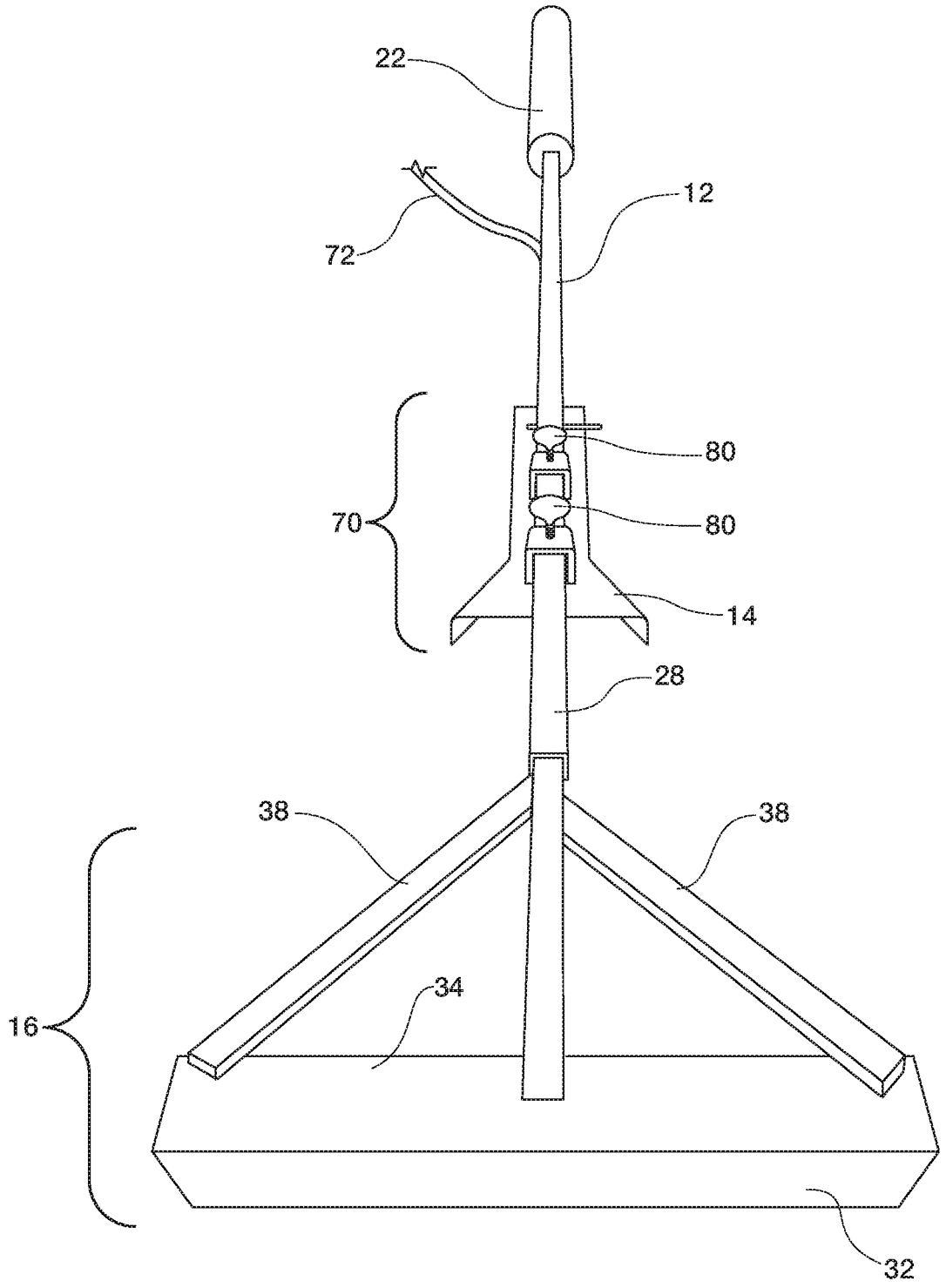
FIG. 1 is a top perspective view of an assembly according to one embodiment of the disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing embodiments of the disclosure and are not intended to limit the disclosure or any inventions thereto. As best seen in FIG. 1, the assembly for delivering/applying/manipulating, etc. the composition includes an application arm 12, torch exhaust 14, and applier 16. Typically, the device includes a handle 22, for instance opposing the distal end 28 of the application arm 12. The torch module 70, for instance a pressurized fuel connector module, may be positioned between the distal end 28 and the handle 22. As shown and described herein, the torch exhaust is moveable along application arm to meet heat demands of any of the applier embodiments and examples shown herein. Further, applier 16 may be moveably positionable and/or interchangeable as shown and described herein to provide universal delivering/applying/manipulating, etc. demand.

Figure 2:
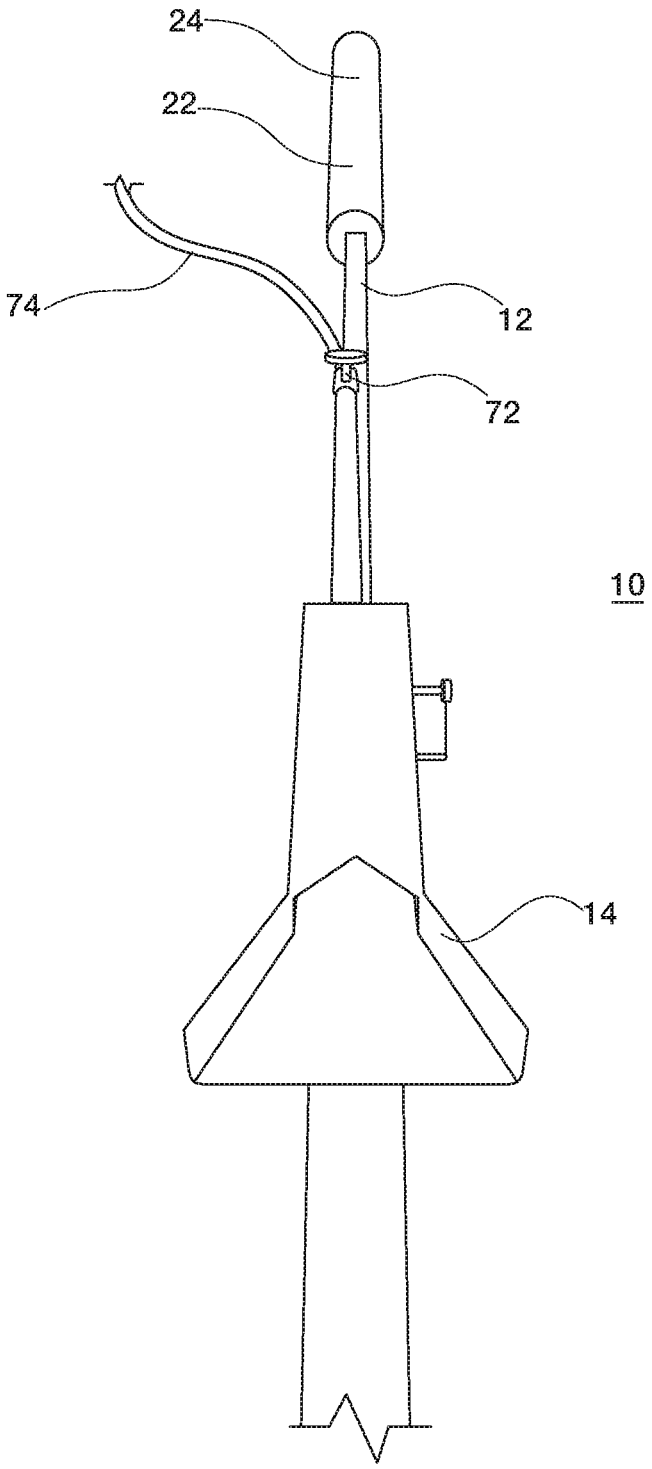
FIG. 2 is a top perspective view of an application arm embodiment introduced in FIG. 1.
Figure 3:
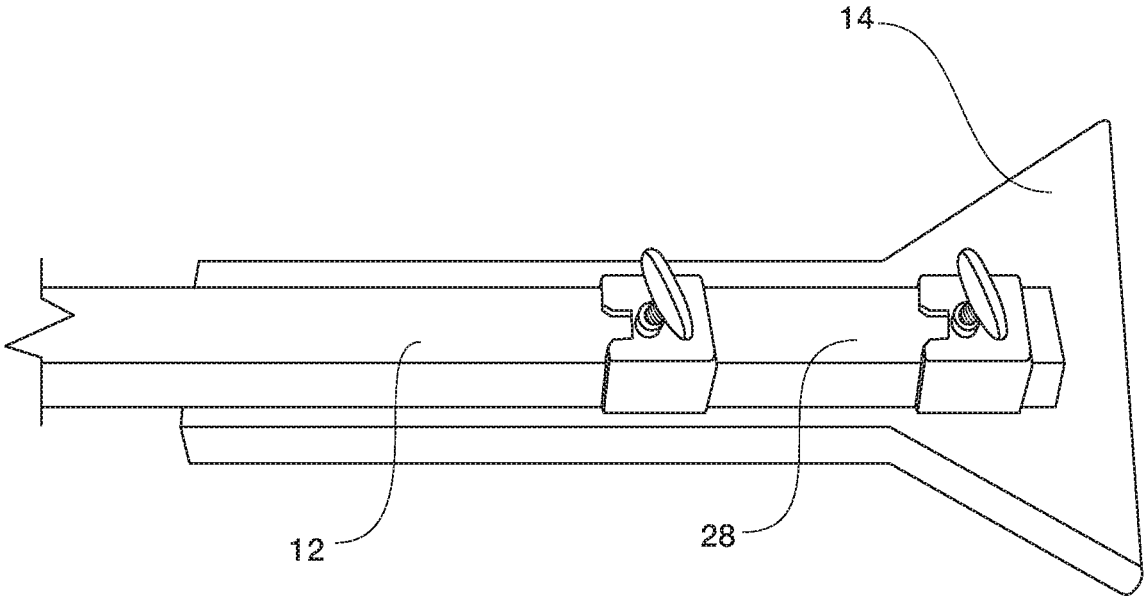
FIG. 3 is an isolated bottom perspective view of the application arm in FIG. 2.
Figure 4:
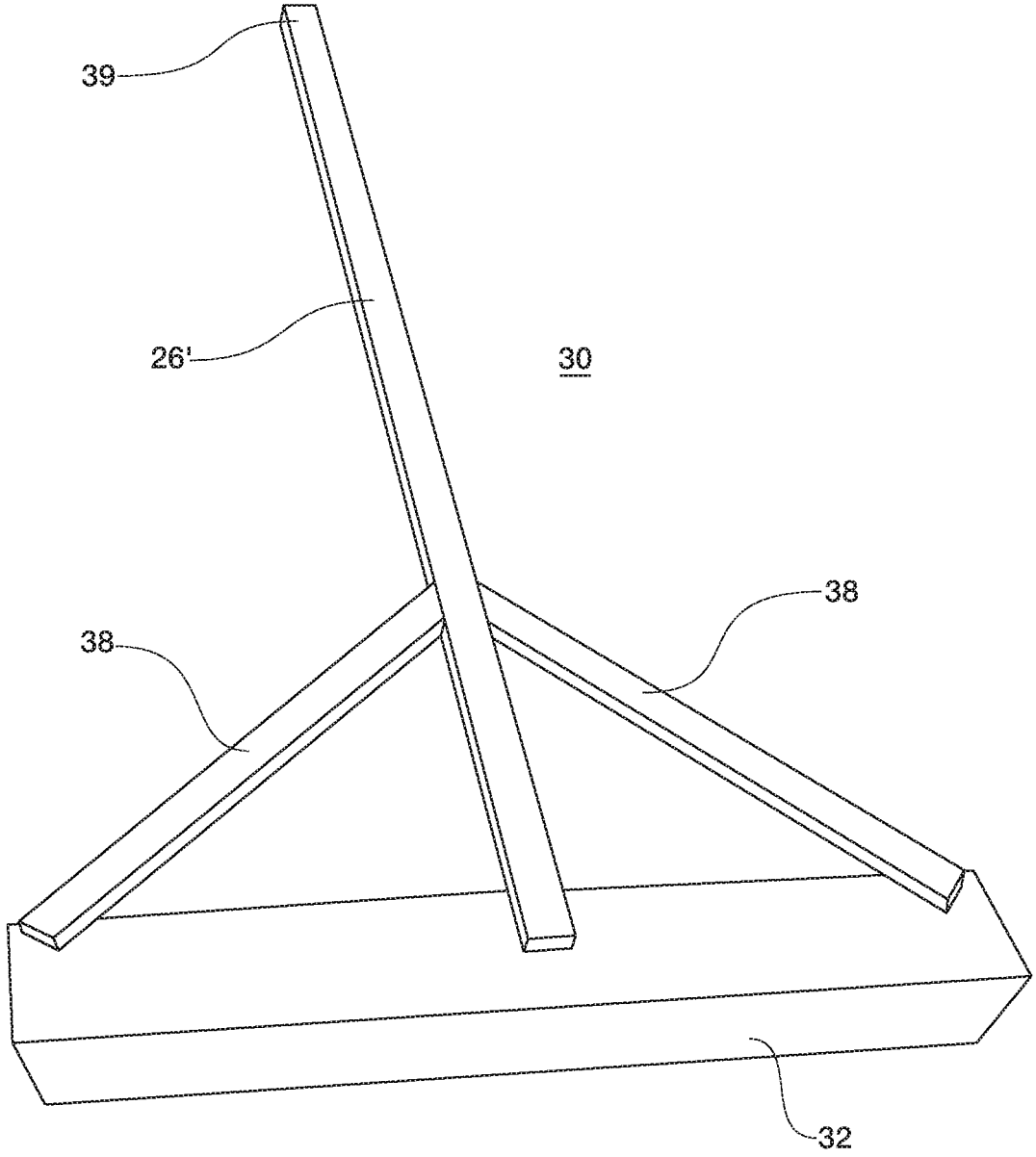
FIG. 4 is a top perspective view of a grader applier embodiment.

As shown in FIGS. 2-4, the device 10 may have an application arm 12 with an elongated body having a moveable torch exhaust 14 opposing handle 22. In particular examples, handle 22 may have a thermal resistant layer 24 or the like, for instance to dissipate heat and/or provide ergonomic benefits.

Embodiments of the disclosure include any variety of applier 16 for interchange and/or permanent connection to any of the application arms 12 shown and described herein.

FIG. 4 illustrates one example of a grading application applier 30. The applier 30 may apply any composition, including the polymer asphalt binder and construction aggregate composition shown and described herein, for instance via traditional grading/pushing-pulling movements recognized by those skilled in the art having the benefit of this disclosure. However, Applicant has unexpectantly discovered enhanced grading/pushing application of the composition with the applier 30, for instance due to the maintained tool temperature to avoid sticking, hardening, and the like. For instance, applier 30 may directly grade polymer asphalt binder and construction aggregate composition at a site-specific surface. In particular examples, applier 30 grades the composition at a site-specific surface at an application temperature between about 350 and about 400 degrees Fahrenheit.

Applier 30 may include elongated body 26' and a grading end that is substantially perpendicular to the elongated body 26'. In particular examples, the grading end may include a horizontal member 34 aligned substantially ninety degrees from a vertical member 32. Examples of the applier 30 include any size, alignment angle, length and depth of members. In particular examples, vertical member 32 has a length extending from horizontal member 34 to grade composition along a surface.

As illustrated in FIG. 4, applier 30 may include a cross support, for instance a tubin. The applier may include a pair of opposing tubins 38 between horizontal member 34 and elongated body 26'. Further, applier 30 may removably interconnect to any of the application arms shown and described herein, for instance via any mechanical attachment or the like. FIG. 4 illustrates applier 30 having an attachment 39 on the elongated body 26' opposing the grading end, however those skilled in the art having the benefit of this disclosure will recognize additional attachments.

Figure 7:
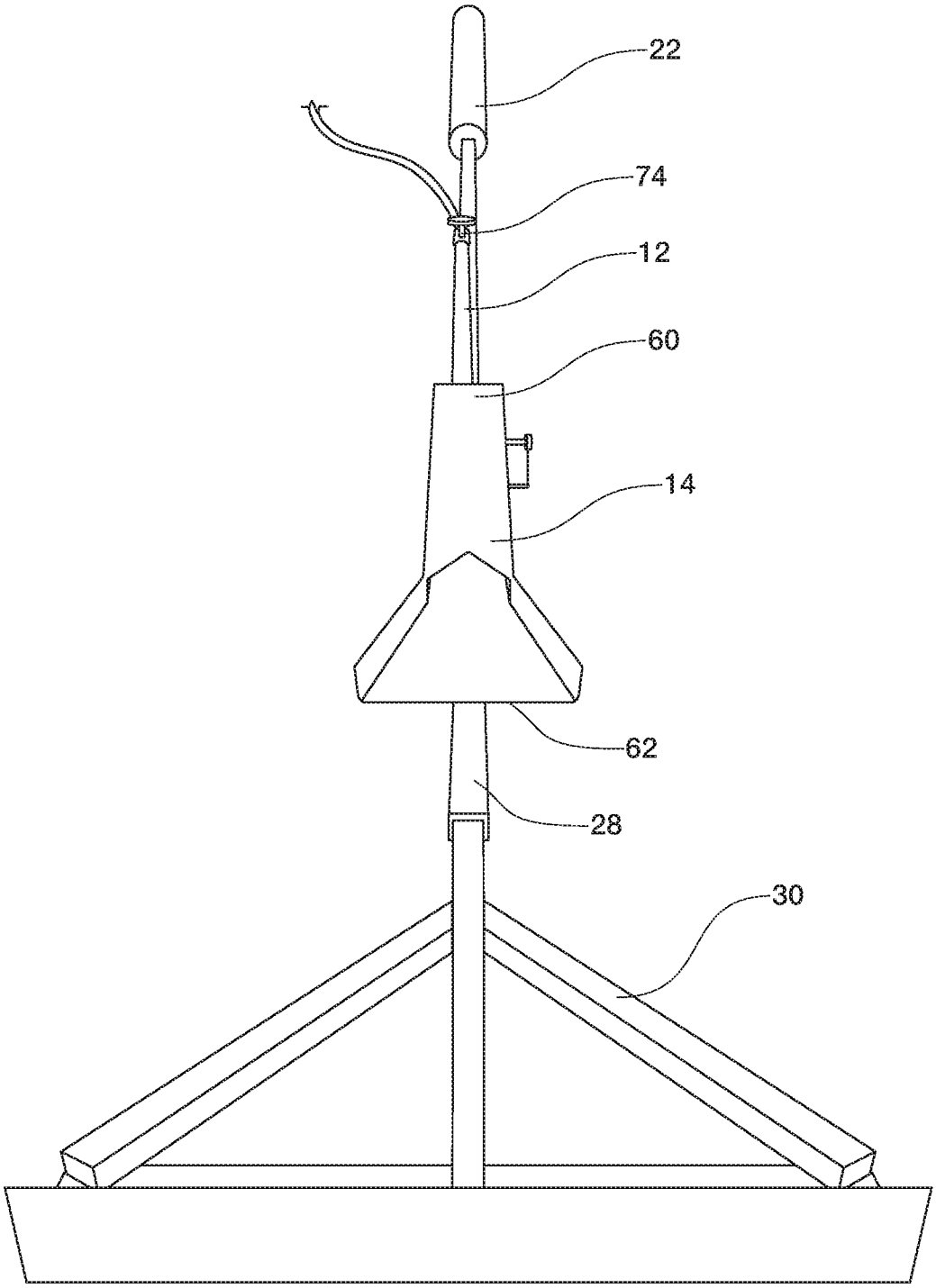
FIG. 7 is a bottom perspective view of an assembly according to one embodiment of the disclosure.

Assemblies having applier 30 are illustrated in FIG. 7, including any of the applier 30 and application arm 12 elements, examples, and embodiments shown and described herein. In particular examples, applier 30 may be interconnectable about the application arm 12, for instance to exchange appliers and the like. Further, the heating elements may be moveable about the application arm to mate a proper orientation, i.e. distance for heat, of applier 30, to a particular site-specific application.

Figure 5:
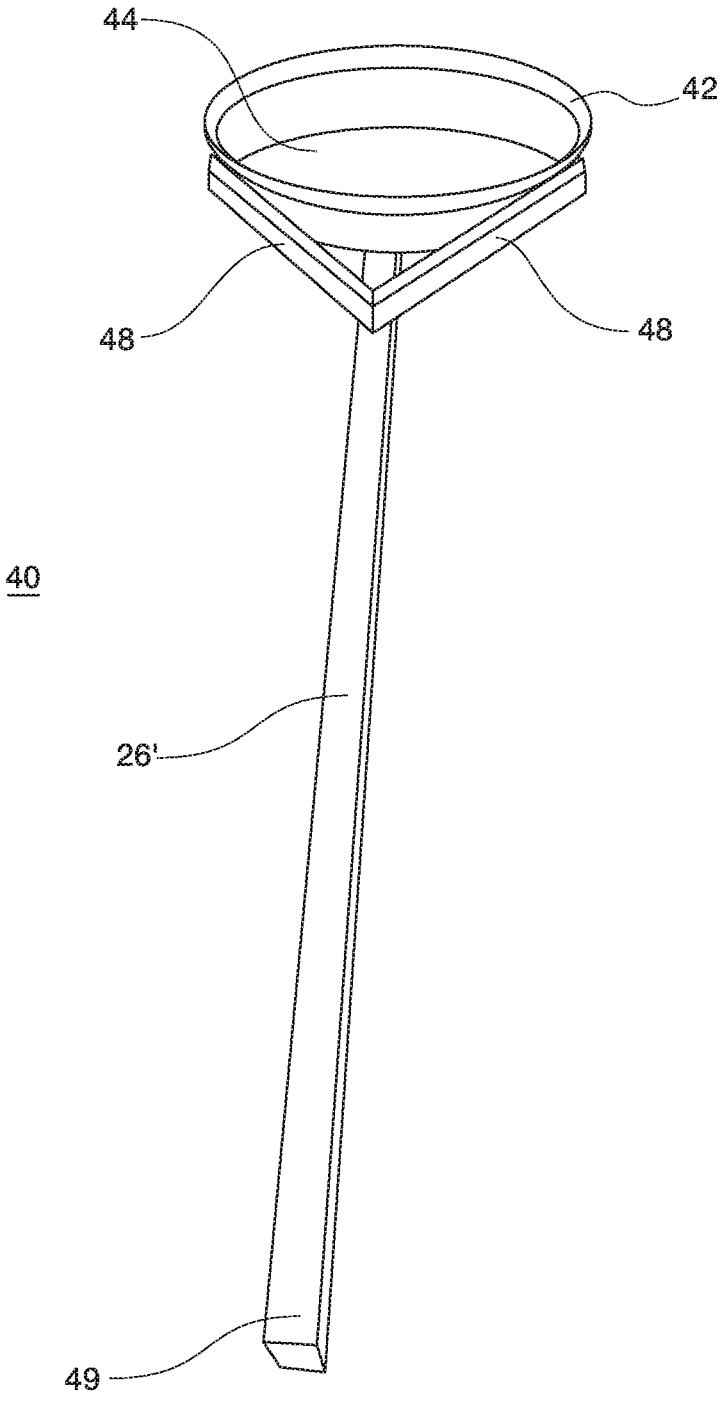
FIG. 5 is a top perspective view of a delivery applier embodiment.

FIG. 5 illustrates one example of a delivery applier 40. The applier 40 may deliver any composition, including the polymer asphalt binder and construction aggregate composition shown and described herein, for instance via scoping, loading, unloading, etc. movements recognized by those skilled in the art having the benefit of this disclosure. However, Applicant has unexpectantly discovered enhanced delivery of the composition with the applier 40, for instance due to the maintained tool temperature to avoid sticking, hardening, and the like. For instance, applier 40 may directly scope, delivery, etc. polymer asphalt binder and construction aggregate composition at a site-specific surface. In particular examples, applier 40 scopes, delivers the composition at a site-specific surface at an application temperature between about 350 and about 400 degrees Fahrenheit.

Applier 40 may include elongated body 26' and a delivery end that is substantially perpendicular to the elongated body 26'. In particular examples, the delivery end may include a concave receiver 42 at a distal end of elongated body 26'. Examples of the concave receiver 42 include any depth, surface area, volume, etc. to receive/deliver the composition. As illustrated in FIG. 5, the concave receiver 42 may include a sunken portion 44 between protruding wall(s), for instance to receive the composition. In one example, the depth of sunken portion 44 is about two to about five inches deep, including about three inches deep. Other examples include additional dimensions and sizes.

As illustrated in FIG. 5, applier 40 may include a cross support, for instance a tubin. The applier may include a pair of opposing tubins 48 between concave receiver 42 and elongated body 26'. Further, applier 40 may removably interconnect to any of the application arms shown and described herein, for instance via any mechanical attachment or the like. FIG. 5 illustrates applier 40 having an attachment 49 on the elongated body 26' opposing the concave receiver end, however those skilled in the art having the benefit of this disclosure will recognize additional attachments.

Figure 8:
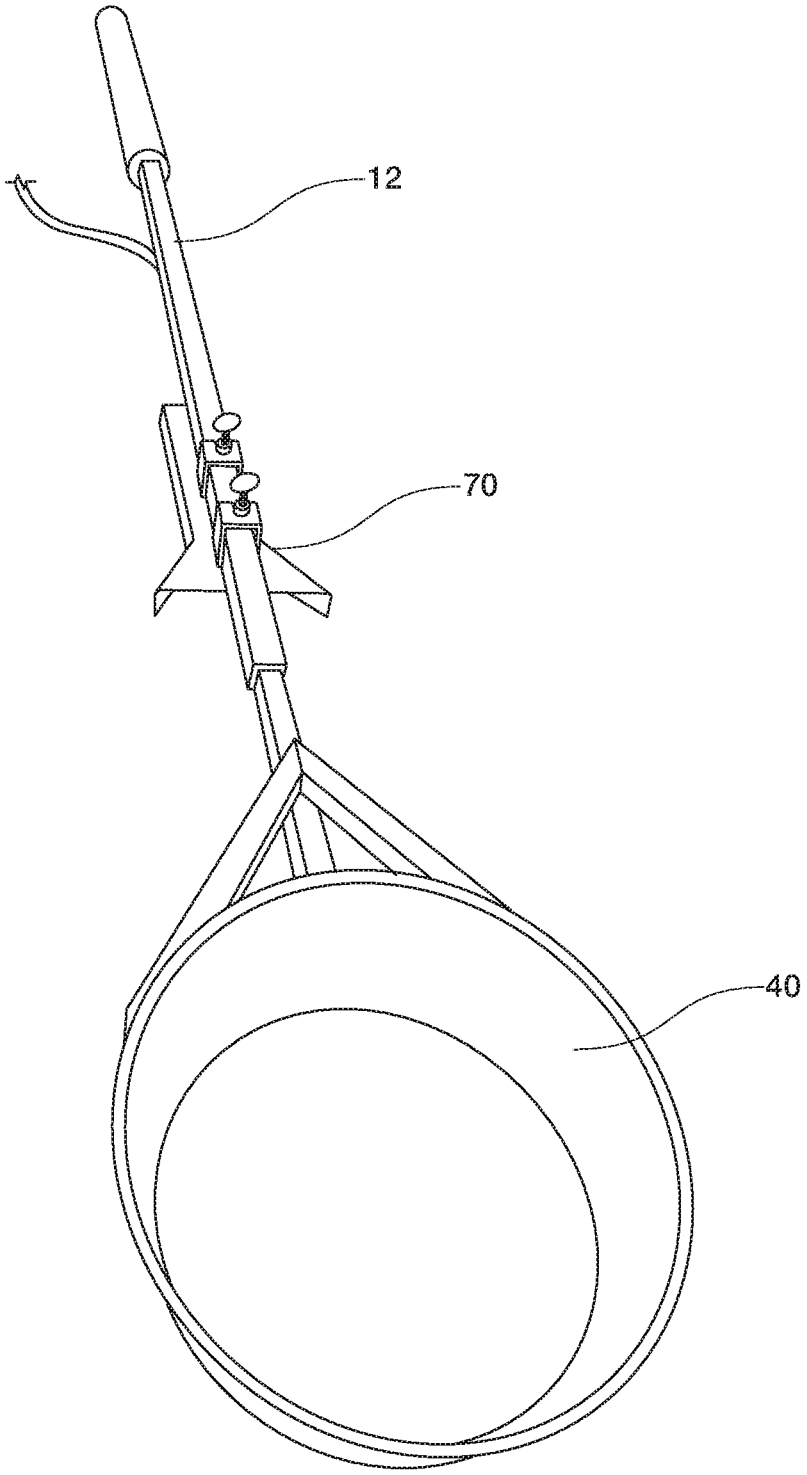
FIG. 8 is a top perspective view of an assembly according to one embodiment of the disclosure.

Assemblies having applier 40 are illustrated in FIG. 8, including any of the applier 40 and application arm 12 elements, examples, and embodiments shown and described herein. In particular examples, applier 40 may be interconnectable about the application arm 12, for instance to exchange appliers and the like. Further, the heating elements may be moveable about the application arm to mate a proper orientation, i.e. distance for heat, of applier 40, to a particular site-specific application.

Figure 6:
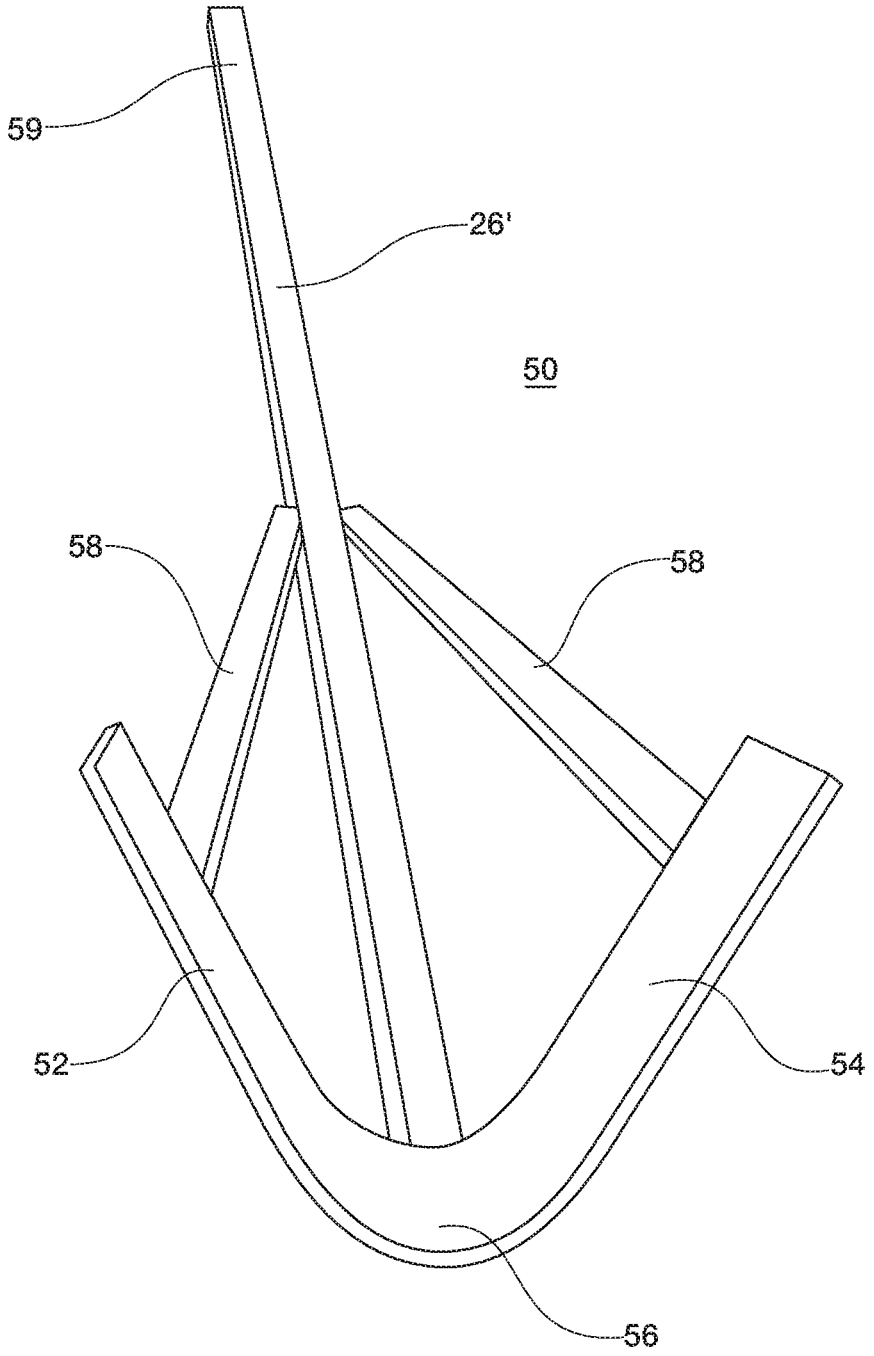
FIG. 6 is a top perspective view of an application applier embodiment.

FIG. 6 illustrates one example of a manipulating applier 50. The applier 50 may manipulate, fill cracks, lengthy holes, and the like with any composition, including the polymer asphalt binder and construction aggregate composition shown and described herein, for instance via crack pulling, pushing, etc. movements recognized by those skilled in the art having the benefit of this disclosure. However, Applicant has unexpectantly discovered enhanced manipulation of the composition with the applier 50, for instance due to the maintained tool temperature to avoid sticking, hardening, and the like. For instance, applier 50 may directly manipulate, etc. polymer asphalt binder and construction aggregate composition at a site-specific surface. In particular examples, applier 50 manipulates the composition at a site-specific surface at an application temperature between about 350 and about 400 degrees Fahrenheit.

Applier 50 may include elongated body 26' and a manipulating end that is substantially perpendicular to the elongated body 26'. In particular examples, the manipulating end may include a first lateral member 52 and a second lateral member 54 that is offset from first lateral 52. Typically, the first lateral member 52 and a second lateral member 54 extend away from a distal end of the applier, for instance at a corner 56. Examples of first lateral member and second lateral member include any orientation, size, abutting angle, etc. to provide a structure for manipulating the composition. As illustrated in FIG. 6, first lateral member 52 and second lateral member 54 may be angled to improve manipulation about a crack and the like. In certain examples, first lateral member 52 and second lateral member 54 are positioned between about forty-five and about sixty-five degrees from the horizontal plane of elongated body 26', including about fifty-five degrees.

As illustrated in FIG. 6, applier 50 may include a cross support, for instance a tubin. The applier may include a pair of opposing tubins 58 between the lateral members and elongated body 26'. Further, applier 50 may removably interconnect to any of the application arms shown and described herein, for instance via any mechanical attachment or the like. FIG. 7*b* illustrates applier 50 having an attachment 59 on the elongated body 26' opposing the lateral members end, however those skilled in the art having the benefit of this disclosure will recognize additional attachments.

Figure 9:
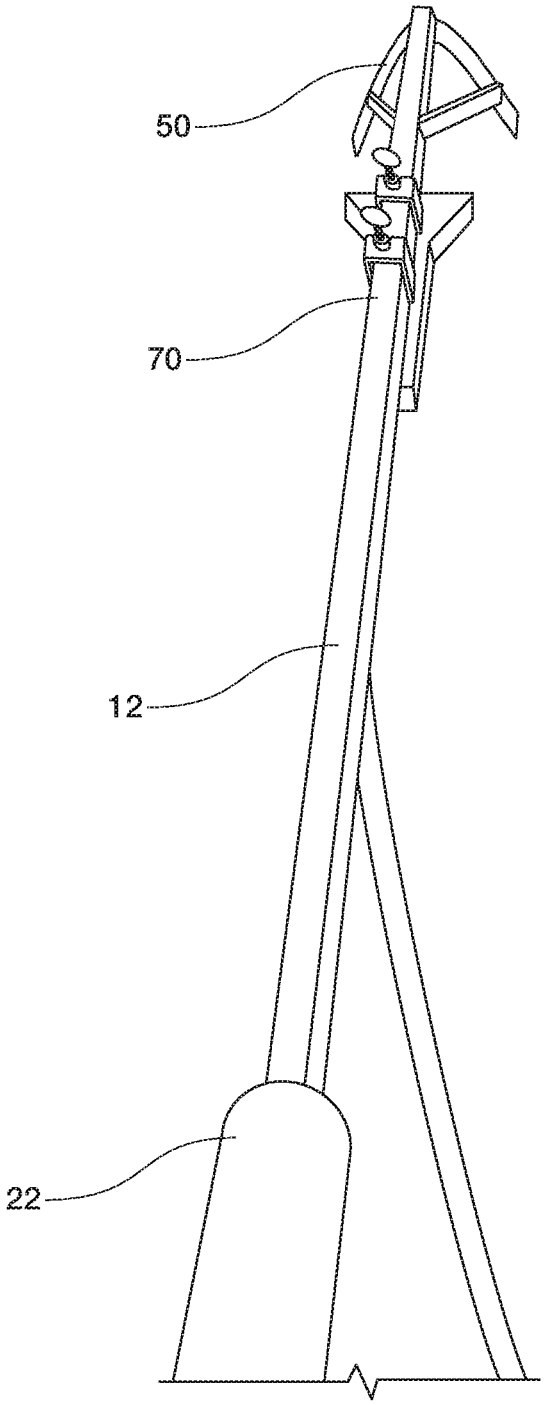
FIG. 9 is a bottom perspective view of an assembly according to one embodiment of the disclosure.

Assemblies having applier 50 are illustrated in FIG. 9, including any of the applier 50 and application arm 12 elements, examples, and embodiments shown and described herein. In particular examples, applier 50 may be interconnectable about the application arm 12, for instance to exchange appliers and the like. Further, the heating elements may be moveable about the application arm to mate a proper orientation, i.e. distance for heat, of applier 50, to a particular site-specific application.

Any of the assemblies herein may provide an application arm having an applier heated by a torch to about 400 degrees Fahrenheit to deliver/manipulate/etc. a composition. The composition may be a polymer asphalt binder and construction aggregate composition. The composition may be a hot-applied, pourable patching material. The composition may be a self-adhesive patching material. The composition may be a hot-applied asphalt material. The composition may be a hot-applied concrete material.

In particular examples, the composition bonds to asphalt concrete, portland cement concrete, concrete, roadway surfaces, bridge deck surfaces, and the like.

In particular examples, any of the delivery and applier elements and components previously shown or described may include an electric start to heat the device(s) and composition to any of the application parameters shown and described herein. The electric start may be a single toggle to initiate a spark, flame or the like as recognized by someone skilled in the art having the benefit of this disclosure.

In other embodiments, the disclosure includes a surfacing kit. In such an embodiment, the kit may comprise an application arm, e.g. any of the application arm elements and components previously shown or described. Further, other embodiments of the kit may comprise an applier, e.g. any of the applier elements and components previously shown or described.

Numerous characteristics and advantages have been set forth in the foregoing description, together with details of structure and function. Many of the novel features are pointed out in the appended claims. The disclosure, however, is illustrative only, and changes may be made in detail, especially in matters of shape, size and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

What I claim is:

1. A device for applying a polymer asphalt binder and construction aggregate composition, said device comprising:

a. an application arm having an elongated body and an interconnect distal end adapted to receive an interchangeable applier; and b. a moveable torch exhaust aligned on said application arm adjacent said distal end to maintain between a 350 and about 400 degrees Fahrenheit temperature about said composition, and wherein said device directly contacts and applies said polymer asphalt binder and construction aggregate composition to a site-specific surface.

2. The device of claim 1, wherein said torch exhaust being moveable between two or more positions along said elongated body.

3. The device of claim 1, wherein said torch exhaust having a narrow proximate portion and an enlarged distal portion.

4. The device of claim 1, wherein said application arm includes a handle opposing said interchangeable applier.

5. The device of claim 1, wherein said site-specific surface is chosen from a surface consisting essentially of a surface distress, a thin crack, and a feathered edge.

6. The device of claim 1, further including an interchangeable applier.

7. The device of claim 6, wherein said interchangeable applier comprises a grader apparatus.

8. The device of claim 6, wherein said interchangeable applier comprises a delivery apparatus.

9. The device of claim 6, wherein said interchangeable applier comprises a crack filler application apparatus.

10. The device of claim 1, wherein said torch exhaust having a pressurized fuel connector module.

11. The device of claim 10, wherein said connector module includes an anchor system.

12. A surface repair system comprising:

a. a first device with an application arm having a torch heating element and an interconnect end adjacent said torch heating element and supporting an applier; and b. at least a second device with an application arm having a torch heating element and an interconnect end adjacent said torch heating element and supporting an applier, different from said applier of said first device, and wherein said first device and said second device are adapted to apply a polymer asphalt binder and construction aggregate composition to a site specific repair at a maintained temperature.

13. The system of claim 12, further including a portable delivery to position a composition batch adjacent said site-specific repair.

14. The system of claim 12, wherein said first device's interchangeable applier comprises a delivery apparatus.

15. The system of claim 12, wherein said second device's interchangeable applier comprises a crack application filler.

16. A hand held assembly comprising:

a. an application arm having an applier;

b. a heating element having an exhaust aligned about said applier and adapted to heat said applier to about 400 degrees Fahrenheit; and c. a polymer asphalt binder and construction aggregate composition removably deliverable about said applier, wherein said heat extends to said composition in a delivery position.

17. The assembly of claim 16, wherein said composition comprises a hot-applied, pourable patching material.

18. The assembly of claim 16, wherein said composition comprises a hot-applied asphalt material.

19. The assembly of claim 16, wherein said composition bonds to asphalt concrete.

20. The assembly of claim 16, wherein said composition bonds to portland cement concrete.

* * * * *